US005677098A

United States Patent [19]

Nakayama et al.

[11] Patent Number: 5,677,098

[45] Date of Patent: Oct. 14, 1997

[54] IMAGE FORMATION METHOD USING BEAM EXPOSURE

[75] Inventors: Takao Nakayama; Eiichi Kato; Kazuo Ishii, all of Kanagawa, Japan

[73] Assignee: Fuji Photo Film Co., Ltd., Kanagawa, Japan

[21] Appl. No.: 578,949

[22] Filed: Dec. 27, 1995

[30] Foreign Application Priority Data

Dec. 27, 1994 [JP] Japan ..... 6-325899
Apr. 3, 1995 [JP] Japan ..... 7-077796

[51] Int. Cl.[6] ..... G03G 5/10

[52] U.S. Cl. ..... 430/95; 430/127; 430/945

[58] Field of Search ..... 430/91, 92, 93, 430/95, 127

[56] References Cited

U.S. PATENT DOCUMENTS 4,857,431 8/1989 Kato et al. ..... 430/95
4,929,527 5/1990 Kato et al. ..... 430/95
5,089,367 2/1992 Murasawa et al. ..... 430/95

*Primary Examiner*—John Goodrow

*Attorney, Agent, or Firm*—Sughrue, Mion, Zinn, Macpeak & Seas, PLLC

[57] ABSTRACT

A method for forming an image using beam exposure of an electrophotosensitive material comprising an electrically conductive support having thereon an electrophotosensitive layer containing an inorganic photoconductor, a chemical sensitizer, a spectral sensitizing dye and a binder resin, wherein the spectral sensitizing dye is at least one dye selected from the compounds represented by formulae (I) and (II) defined in the disclosure and the surface of the electrically conductive support on the side of the electrophotosensitive layer has a BEKK smoothness of 300 sec/10 cc or more.

5 Claims, 1 Drawing Sheet

IMAGE FORMATION METHOD USING BEAM EXPOSURE

FIELD OF THE INVENTION

The present invention relates to an image formation method using beam exposure, more specifically, it relates to an image formation method using beam exposure which can provide a photocopy or printed material excellent in image quality.

BACKGROUND OF THE INVENTION

According to a conventional method for producing a photocopy or a lithographic printing plate, an electrophotosensitive layer of an electrophotosensitive material is uniformly charged and imagewise exposed, the exposed material is subjected to wet development with a liquid toner to obtain a toner image and then the toner image is fixed. In case of use as a printing plate, a method where the printing plate is processed with a desensitizing solution (etching solution) to hydrophilize the non-image area free of the toner image is commonly used.

As a support for the above-described lithographic printing plate, a paper imparted with an electric conductivity has hitherto been used but the printing durability or photographic properties are affected by the penetration of water into the support. More specifically, the above-described etching solution or fountain solution at the printing penetrates into the support thereby expanding the support, which sometimes causes separation between the support and the electrophotosensitive layer thereby reducing the printing durability. Also, the water content of the support varies depending upon the temperature and humidity conditions in an atmosphere during the above-described electrostatic charging or exposure and whereby the electric conductivity of the support is changed to impair the photographic properties. Further, lack of water resistance causes wrinkles during printing.

In order to overcome these problems, it has been proposed to coat one or both sides of the support with a water-resistant material, for example, an epoxy resin or an ethylene and acrylic acid copolymer (see, JP-A-50-138904 (the term "JP-A" as used herein means an "unexamined published Japanese patent application"), JP-A-55-105580 and JP-A-59-68753) or to provide a laminate layer such as polyethylene (see, JP-A-58-57994).

On the other hand, the image exposure method includes a scanning image exposure method using beams such as laser beams. Particularly in recent years, as a low output semiconductor laser is developed, a photosensitive material sensitive to the wavelength region of 700 nm or more is being demanded. Such a photosensitive material uses various sensitizing dyes and is required to show satisfactory sensitivity to near infrared light or infrared light and also to have good dark-charge receptive properties.

However, when exposure is conducted using laser beams or the like, the image obtained is reduced remarkably in the image quality. As a result of investigations, this is found to be ascribable to fine unevenness existing on the surface of a paper imparted with electric conductivity or a support having a laminate layer as used in conventional supports. More specifically, due to unevenness on the support, the surface of the photosensitive layer provided on the electrically conductive support also has unevenness thereby causing extremely reduction in the image quality. Further, even when the surface of the photosensitive layer provided on the support is rendered smooth, the thickness of the photosensitive layer becomes uneven and whereby electrophotographic properties (in particular, photosensitivity, electrostatic charge) vary according to the sites on the photosensitive layer, which results in remarkable reduction in the image quality (sharpness of image, uniformity of solid image). This problem comes out outstandingly when the environment at the time of image formation is changed.

Thus, actually, no conventional image formation method has succeeded in providing good electrophotographic properties, in forming an image having very excellent image quality, in particular, sharpness of the image, and in achieving good uniformity of the solid image.

SUMMARY OF THE INVENTION

As a result of intensive investigations to overcome the above-described problems, the present inventors have succeeded in solving these problems by using a specific spectral sensitizing dye and further setting the smoothness of the surface of the electrically conductive support to fall within a specific range. More specifically, they have found that the above-described problems can be overcome by the present invention of the following constitutions.

Namely, the present invention provides (1) a method for forming an image using beam exposure of an electrophotosensitive material comprising an electrically conductive support having thereon an electrophotosensitive layer containing an inorganic photoconductor, a chemical sensitizer, a spectral sensitizing dye and a binder resin, wherein the spectral sensitizing dye is at least one dye selected from the compounds represented by the following formulae (I) and (II) and the surface of the electrically conductive support on the side of the electrophotosensitive layer has a BEKK smoothness of 300 sec/10 cc or more:

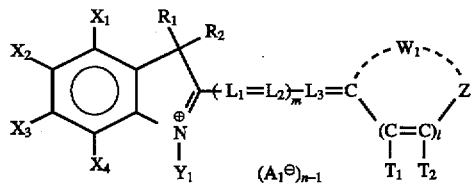

(I)

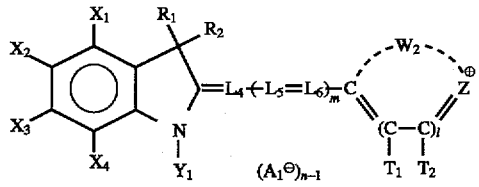

(II)

wherein $R_1$ and $R_2$, which may be the same or different, each represents an alkyl group, an alkenyl group or an aralkyl group or $R_1$ and $R_2$ may be a hydrocarbon group for forming an alicyclic ring together;

$X_1$, $X_2$, $X_3$ and $X_4$, which may be the same or different, each represents a hydrogen atom or a group selected from respective substituent groups defined by the Hammett's substituent constant, or $X_1$ and $X_2$ or $X_3$ and $X_4$ may be a hydrocarbon group for forming a benzene ring together;

$Y_1$ represents an alkyl, alkenyl or aralkyl group which may be substituted;

Z represents an oxygen atom, a sulfur atom, a selenium atom, a tellurium atom or a nitrogen atom substituted by a substituent $Y_2$ (wherein $Y_2$ has the same meaning as $Y_1$ above and $Y_1$ and $Y_2$ in each formula may be the same or different);

$W_1$ represents an atomic group necessary for forming an indolenine, naphthoindolenine, pyran, benzopyran, naphthopyran, thiopyran, benzothiopyran, naphthothiopyran, selenapyran, benzoselenapyran, naphthoselenapyran, tellurapyran, benzotellurapyran, naphthotellurapyran, benzothiazole or naphthothiazole ring which may be substituted or an atomic group necessary for forming a nitrogen-containing heterocyclic ring which may be substituted;

$W_2$ represents an onium salt of a heterocyclic group as formed in the manner defined for $W_1$;

$T_1$ and $T_2$, which may be the same or different, each represents a hydrogen atom, an aliphatic group or an aromatic group;

$L_1$, $L_2$, $L_3$, $L_4$, $L_5$ and $L_6$, which may be the same or different, each represents a methine group which may be substituted;

l represents 0 or 1;

m represents 2 or 3;

$A_1^-$ represents an anion; and n represents 1 or 2, provided that when the dye molecule contains a sulfo group or a phospho group, an inner salt is formed and n is 1, and an electrophotosensitive material to be used in this method.

The present invention also provides (2) an image formation method using beam exposure as described above as (1), wherein the electrically conductive support has a resin layer in a thickness of 10 μm or more which is melt-bonded to the support and the surface of the support on the side of the electrophotosensitive layer has a BEKK smoothness of 300 sec/10 ml or more.

The present invention further provides (3) an image formation method using beam exposure as described above as (1) or (2), wherein the electrophotosensitive material is subjected to wet development by disposing an electrode to face the electrophotosensitive layer, supplying a developer between the electrode and the electrophotosensitive layer and bringing a conductor into contact with the surface of the support on the side opposite to the electrophotosensitive layer.

DETAILED DESCRIPTION OF THE INVENTION

Figure 1:
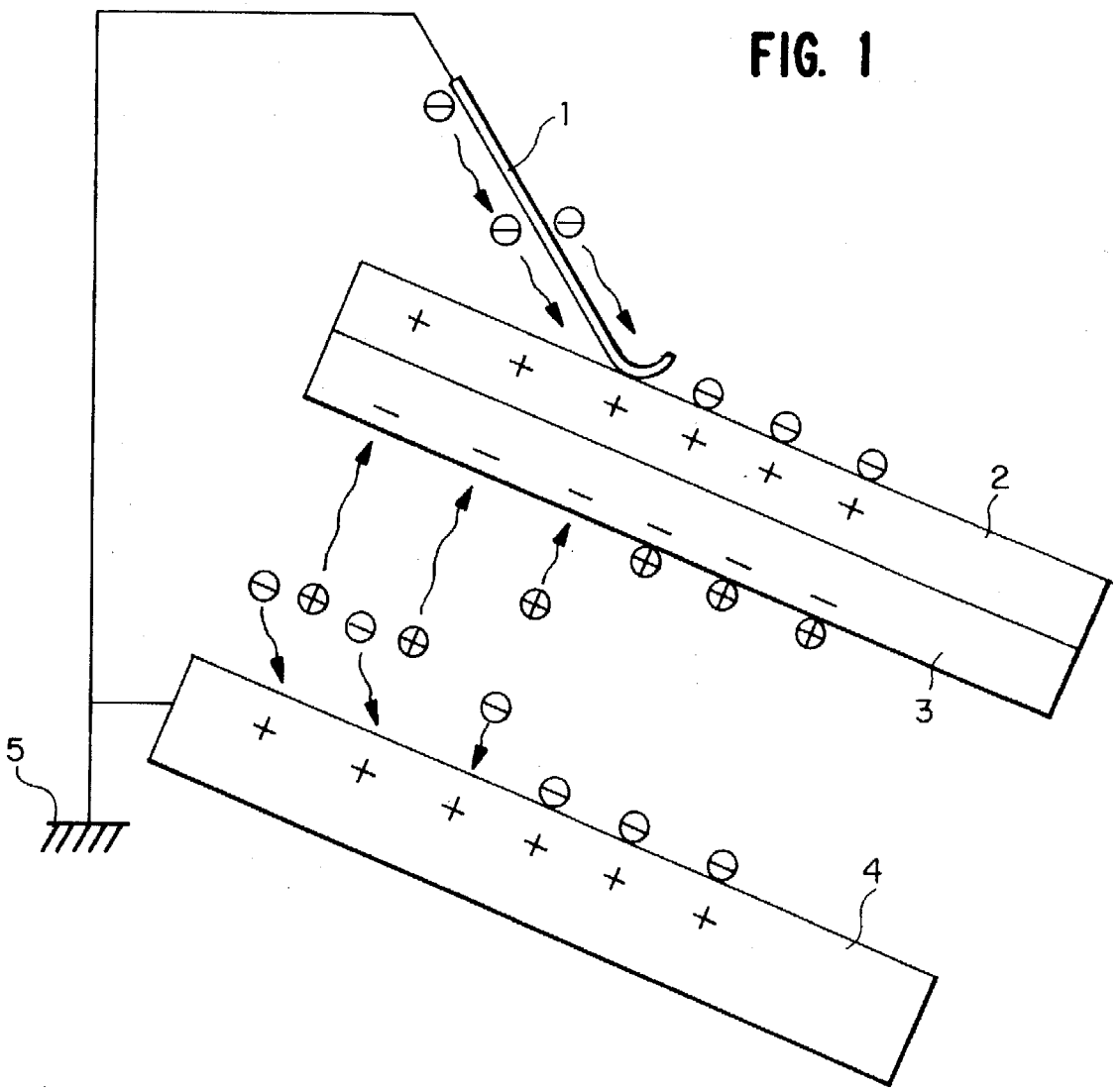
FIG. 1 is a principle view of a development method in a direct feeding system which is suitably used in the present invention.

The method of the present invention is described below in detail.

As the spectral sensitizing dye for use in the method of the present invention, at least one of the compounds represented by formulae (I) and (II) is used. By using this compound, satisfactory sensitivity to near infrared light or infrared light, good applicability to exposure by beams, excellent electrophotographic properties and high image quality can be achieved. Also, superior image reproducibility can be ensured even when the environment fluctuates.

Preferred embodiments of the compound represented by formula (I) or (II) are described below.

$R_1$ and $R_2$, which may be the same or different, each represents an alkyl group having from 1 to 6 carbon atoms which may be substituted (e.g., methyl, ethyl, propyl, butyl, pentyl, hexyl, 2-methoxyethyl, 3-methoxypropyl, 3-cyanopropyl), an alkenyl group having from 3 to 6 carbon atoms which may be substituted (e.g., allyl, 1-propenyl, 1-methylethenyl, 3-butenyl) or an aralkyl group having from 7 to 9 carbon atoms which may be substituted (e.g., benzyl, phenethyl, 3-phenylpropyl, 1-methylbenzyl, methoxybenzyl, chlorobenzyl, fluorobenzyl, methoxybenzyl).

Also, $R_1$ and $R_2$ each represents a hydrocarbon group constituting a 5-, 6-, 7- or 8-membered alicyclic ring and the alicyclic ring may contain a substituent (e.g., cyclopentyl ring, cyclohexyl ring, cycloheptane ring, methylcyclohexyl ring, methoxycyclohexyl ring, cyclohexene ring, cycloheptene ring).

$X_1$, $X_2$, $X_3$ and $X_4$, which may be the same or different, each represents a hydrogen atom, a carboxy group, a sulfo group, a phospho group, a hydroxy group, a halogen atom (e.g., fluorine, chlorine, bromine), a nitro group, a cyano group, an alkyl group having from 1 to 6 carbon atoms which may be substituted (e.g., methyl, ethyl, propyl, butyl, hexyl, chloromethyl, trifluoromethyl, 2-methoxyethyl, 2-chloroethyl), an aralkyl group having from 7 to 12 carbon atoms which may be substituted (e.g., benzyl, phenethyl, chlorobenzyl, dichlorobenzyl, methoxybenzyl, methylbenzyl, dimethylbenzyl), an aryl group which may be substituted (e.g., phenyl, naphthyl, indenyl, tolyl, xylyl, mesityl, chlorophenyl, dichlorophenyl, ethoxyphenyl, cyanophenyl, acetylphenyl, methanesulfonylphenyl), —O—$R_1$', —S—$R_1$', —C(=O)—$R_1$', —$SO_2$—$R_1$', —OCO—$R_1$', —COO—$R_1$' (wherein $R_1$' represents the same group as the aliphatic group represented by $R_1$ or $R_2$, an aryl group which may be substituted (e.g., phenyl, naphthyl, tolyl, xylyl, chlorophenyl, fluorophenyl, methoxyphenyl, bromophenyl, acetylphenyl, acetamidophenyl) or a heterocyclic group (e.g., thienyl, pyridyl, imidazolyl, chlorothienyl, pyrrole)), —CON($R_2$')($R_3$') or —$SO_2$N($R_2$')($R_3$') (wherein $R_2$' and $R_3$', which may be the same or different, each represents a hydrogen atom, an alkyl group having from 1 to 8 carbon atoms which may be substituted (e.g., methyl, ethyl, propyl, butyl, hexyl, octyl, 2-chloroethyl, 3-chloropropyl, 3-hydroxypropyl, 2-bromoethyl, 2-hydroxyethyl, 2-sulfoethyl, 2-cyanoethyl, 2-methoxyethyl, 2-ethoxyethyl, 2-carboxyethyl, 3-hydroxypropyl, 2-sulfoethyl, 4-hydroxypropyl, 2-(4-sulfobutyl)ethyl, 2-methanesulfonylethyl, 3-ethoxypropyl, 2,2,2-trifluoroethyl), an alkenyl group having from 2 to 8 carbon atoms which may be substituted (e.g., vinyl, allyl, 3-butenyl, 2-hexenyl, 6-hexenyl), an aralkyl group having from 7 to 12 carbon atoms which may be substituted (e.g., benzyl, phenethyl, chlorobenzyl, methylbenzyl, sulfobenzyl, carboxybenzyl, methoxy-carbonylbenzyl, acetamidobenzyl, methoxybenzyl, dichlorobenzyl, cyanobenzyl, trimethylbenzyl), a phenyl group which may be substituted (e.g., phenyl, tolyl, xylyl, butylphenyl, chloromethylphenyl, methoxyphenyl, ethoxyphenyl, butoxyphenyl, acetamidophenyl, carboxyphenyl, sulfophenyl, trifluoromethylphenyl, chloromethylphenyl) or an organic residue for forming a ring through a hetero atom by combining $R_2$' and $R_3$' (e.g., piperazyl, piperidyl, indolinyl, morpholinyl, isoindolinyl)).

$X_1$, and $X_2$or $X_3$ and $X_4$ may represent a hydrocarbon group for forming a benzene ring together and the condensed ring formed may contain the same substituent as described above for $X_1$, $X_2$, $X_3$ or $X_4$.

$y_1$ represents an alkyl group having from 1 to 18 carbon atoms which may be substituted (e.g., methyl, ethyl, propyl, butyl, pentyl, hexyl, octyl, nonyl, decyl, dodecyl, tridecyl, tetradecyl, hexadecyl, octadecyl, 2-methoxyethyl, 2-ethoxyethyl, 2-(2-methoxyethyloxy)ethyl, 2-hydroxyethyl, 2-(2-hydroxyethylethoxy)ethyl, 3-hydroxypropyl, 6-hydroxyhexyl, 3-cyanopropyl, methoxycarbonylmethyl, 3-ethoxycarbonylpropyl, 4-methoxycarbonylbutinyl, 3-methylcarbonylpropyl, N,N-dimethylaminoethyl, N-methyl-N-benzylaminopropyl, 2-acetoxyethyl, 2-propionyloxyethyl, 2-chloroethyl, 3-chloropropyl, 2,2,2-trichloroethyl, 10-chlorodecyl, carboxymethyl, 2-carboxyethyl, 3-carboxypropyl, 4-carboxybutyl, 2-carboxypropyl, 2-carboxybutyl, 5-carboxypentyl, 2-chloro-3-carboxypropyl, 2-bromo-3-carboxypropyl, 2-hydroxy-3-carboxypropyl, 2-(3'-carboxypropylcarbonyloxy)ethyl, 6-carboxyhexyl, cyclohexylmethyl, 4'-carboxycyclohexylmethyl, methoxycyclointerethyl, 3-(2'-carboxyethylcarbonyloxy) propyl, 2-(2'-carboxyethylcarbamoyl)ethyl, 2-(2'-carboxyethyloxy)ethyl, 2-sulfoethyl, 3-sulfopropyl, 4-sulfobutyl, 2-(3'-sulfopropyloxy)ethyl, 2-(4'-sulfobutyloxy)ethyl, 3-(4'-sulfobutyloxy)propyl, 4-(O'-sulfobenzoyloxy)butyl, 5-sulfopentyl, 8-sulfooctyl, 10-sulfodecyl, 4-(4'-sulfobutyloxy)butyl, 6-(4'-sulfobutyloxy)hexyl, 2-(4'-sulfobutylamino)ethyl, 2-(4'-sulfocyclohexyl)ethyl, 2-phosphoethyl, 2-phosphoxyethyl, 3-phosphoxypropyl, 4-phosphoxybutyl, 3-phosphoxybutyl, 6-phosphoxyhexyl), an alkenyl group having from 2 to 18 carbon atoms which may be substituted (e.g., vinyl, allyl, 3-butenyl, pentenyl, hexenyl, heptenyl, octenyl, decenyl, dodecenyl, octadecenyl, 4-sulfobutenyl, 2-allyloxyethyl, 2-(2'-allyloxyethyloxy)ethyl, 2-allyloxyoxypropyl, 3-(butenylcarbonyloxy)propyl, 2-(2-carboxyethenylcarbonyloxy)ethyl, 4-(allyloxy)butyl) or an aralkyl group having from 7 to 16 carbon atoms which may be substituted (e.g., benzyl, α-methylbenzyl, phenethyl, 3-phenylpropyl, 4-phenylbutyl, chlorobenzyl, bromobenzyl, methylbenzyl, dimethylbenzyl, sulfobenzyl, carboxybenzyl, methoxycarbonylbenzyl, acetamidobenzyl, methoxybenzyl, dichlorobenzyl, cyanobenzyl, trimethylbenzyl, naphthylmethyl, 2-naphthylethyl, 3-naphthylpropyl, 2-(carboxynaphthyl)ethyl, 2-(sulfonaphthyl)ethyl, phosphonoxybenzyl).

Among the groups represented by $Y_1$, the carboxy group, the sulfo group or the phospho group may form a carbonato group, a sulfonato group or a phosphonato group by binding to a cation. The cation is preferably an alkali metal ion (e.g., lithium ion, sodium ion, potassium ion) or an alkaline earth metal ion (e.g., magnesium ion, calcium ion, barium ion).

Further, the carboxy group, the sulfo group or the phospho group may form a salt with an organic base (e.g., pyridine, morpholine, N,N-dimethylaniline, triethylamine, pyrrolidine, piperidine, trimethylamine, diethylmethylamine).

Z represents an oxygen atom, a sulfur atom, a selenium atom, a tellurium atom or a nitrogen atom substituted by a substituent $Y_2$ (wherein $Y_2$ has the same meaning as $Y_1$ above). In each formula, $Y_1$ may be the same with or different from $Y_2$.

n represents 0 or 1.

m represents 2 or 3.

Examples of the heterocyclic ring formed by $W_1$ include a benzothiazole ring, a naphthothiazole ring (e.g., naphtho[2,1-d]thiazole ring, naphtho[1,2-d]thiazole ring), a thionaphthene[7,6-d] ring, a thiazole ring, a benzoxazole ring, a naphthoxazole ring (e.g., naphth[2,1-d]oxazole ring), a selenazole ring, a benzoselenazole ring, a naphthoselenazole ring (e.g., naphtho[2,1-d]selenazole ring, naphtho[1,2-d]selenazole ring), an oxazoline ring, a selenazoline ring, a thiazoline ring, a pyridine ring, a quinoline ring (e.g., 2-quinoline ring, 4-quinoline ring), an isoquinoline ring (e.g., 1-isoquinoline ring, 3-isoquinoline ring), an acrylidine ring, an indolenine ring (e.g., 3,3'-dialkylindolenine ring, cycloalkanespiro-3-indolenine ring, cycloalkanespiro-3'-indolenine ring), a naphthoindolenine ring (e.g., 3,3-dialkylnaphthoindolenine ring) and a benzimidazole ring.

The substituent which the above-described heterocyclic rings may contain includes those described above for $X_1$, $X_2$, $X_3$ and $X_4$.

$W_2$ represents an onium salt of a heterocyclic group as formed in the manner defined for $W_1$.

The methine group represented by $L_1$, $L_2$, $L_3$, $L_4$, $L_5$ or $L_6$ may have a substituent (for example, an alkyl group (e.g., methyl, ethyl, benzyl, 2-sulfoethyl, 2-hydroxyethyl), an aryl group (e.g., phenyl, p-tolyl), a carboxylic acid group, a sulfonic acid group, a cyano group, an amino group (e.g., dimethylamino) or a halogen atom (e.g., F, Cl, Br, I)) or the methine groups may be combined with each other to form a ring. Examples of the ring formed by the methine groups include those represented by the following formulae:

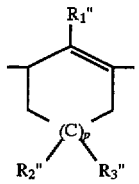

wherein $R_1$" represents a hydrogen atom, a halogen atom (e,g, F, Cl, Br) or —N($R_1$'")($R_2$'") (wherein $R_1$'" and $R_2$'", which may be the same or different, each represents an alkyl group (e,g, methyl, ethyl, propyl, butyl, benzyl, 2-hydroxyethyl, 2-chloroethyl, 2-sulfoethyl, 2-carboxyethyl) or an aryl group (e.g., phenyl, tolyl, xylyl, methoxyphenyl)), $R_2$" and $R_3$", which may be the same or different, each represents a hydrogen atom, a halogen atom (e.g., F, Cl, Br), an alkyl group (e.g., methyl, ethyl, propyl, butyl, benzyl, phenethyl, 2-hydroxyethyl, 2-chloroethyl, 2-carboxyethyl, 2-methoxycarbonylethyl) or an aryl group (e.g., phenyl, tolyl, xylyl, mesityl, methoxyphenyl), and p represents 0 or 1;

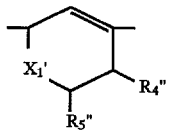

wherein $X_l$' represents a linking group such as —$CH_2$—, —O—, —S— or >N—$R_1$" (wherein $R_1$" has the same meaning as above), $R_4$" and $R_5$", which may be the same or different, each has the same meaning as $R_2$" or $R_3$" above, and $R_4$" and $R_5$" may be combined to form a ring (e.g., cycloheptane ring, cyclohexane ring).

$A_1$' represents an anion and examples thereof include a chlorine ion, a bromine ion, an iodine ion, a thiocyanic acid ion, a methylsulfuric acid ion, an ethylsulfuric acid ion, a benzenesulfonic acid ion, a p-toluenesulfonic acid ion, a perchloric acid ion and a boron tetrabromide ion.

n represents 1 or 2 and when the dye molecule includes a sulfone group or a phospho group, an inner salt is formed and n is 1.

Among the spectral sensitizing dyes described above, preferred are dyes where Z is an oxygen atom, a sulfur atom or a nitrogen atom having a substituent $Y_2$.

Also preferred as the spectral sensitizing dye for use in the present invention are compounds containing at least one acidic group, more preferably two or more acidic groups selected from a carboxyl group, a sulfo group and a phospho group in the dye molecule.

By containing the acidic group, adsorptivity of the dye molecule to the photoconductor is elevated, thereby eliminating bad influence on the electrophotographic properties caused by a dye which is not adsorbed but remains in the layer, and also elevating the storage stability of the dye adsorbed in the layer.

Specific examples of the dye of the present invention are set forth below but the scope of the present invention is by no means limited to these.

Compound (1)

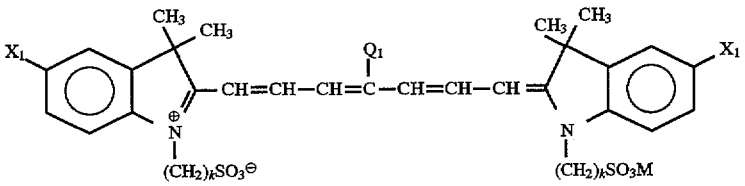

Compound (2)

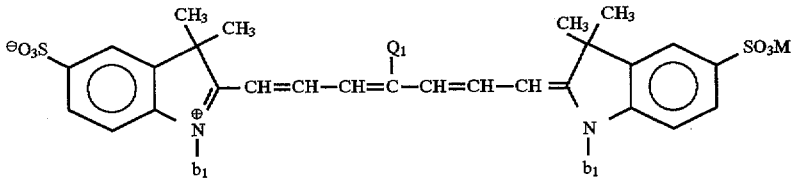

Compound (3)

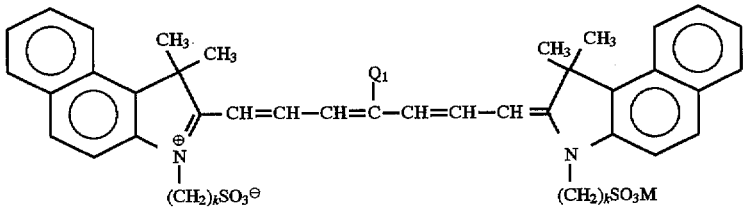

Compound (4)

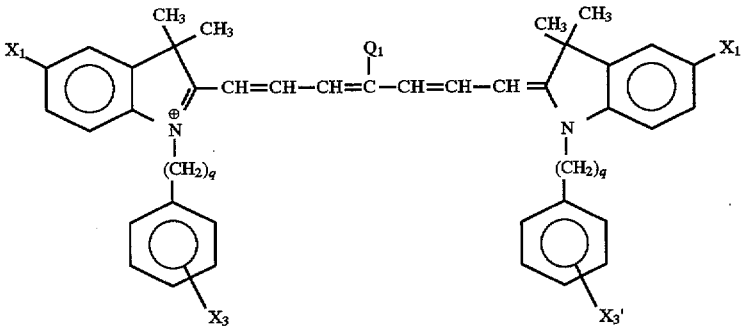

Compound (5)

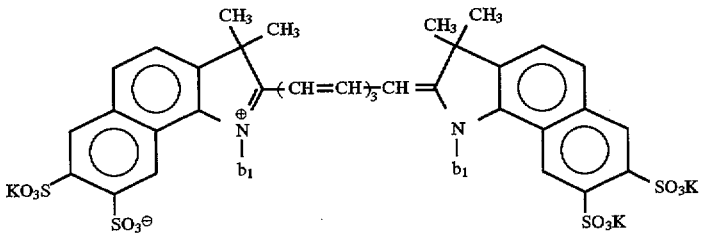

Compound (6)

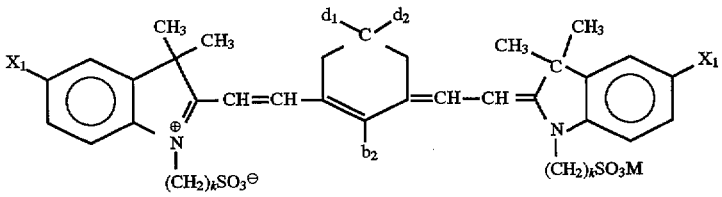

-continued
Compound (7)
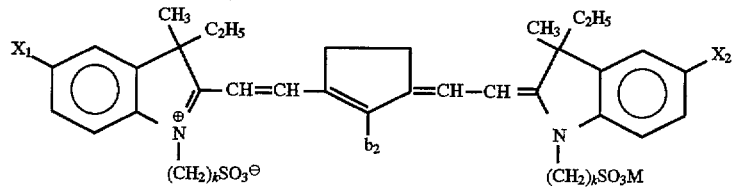
Compound (8)
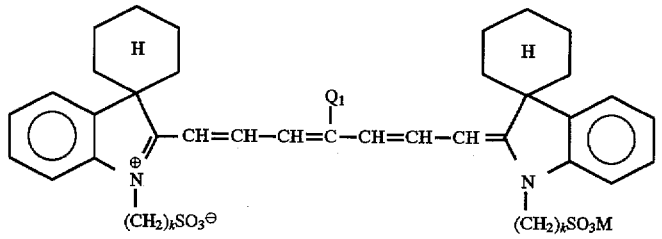
Compound (9)
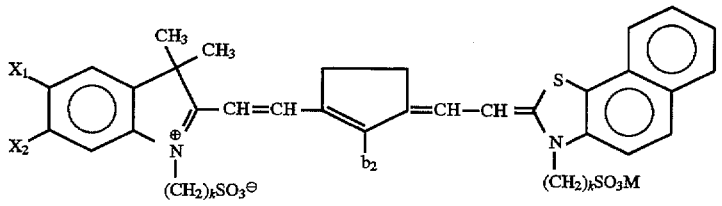
Compound (10)
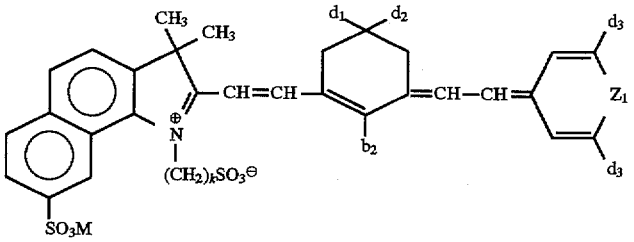
Compound (11)
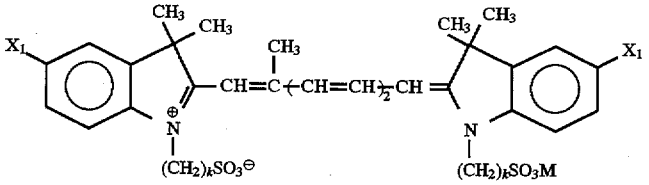
Compound (12)
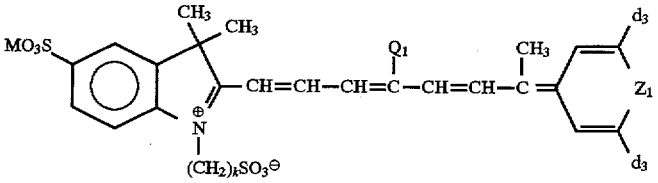
Compound (13)
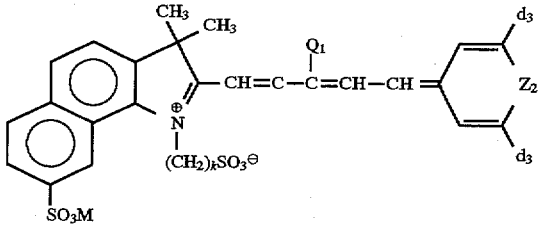

-continued

Compound (14)

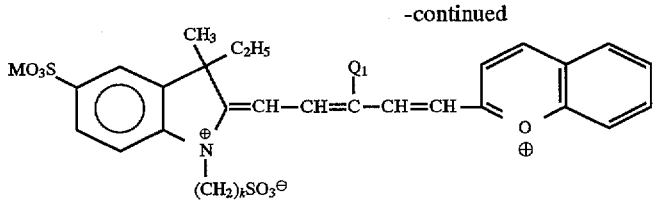

Compound (15)

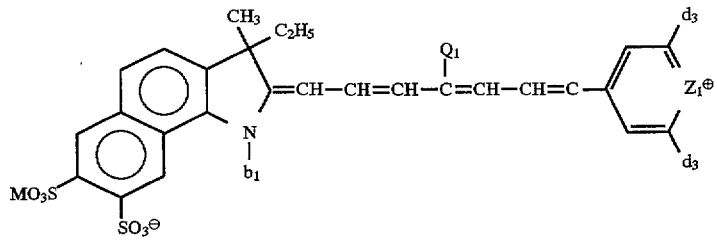

Compound (16)

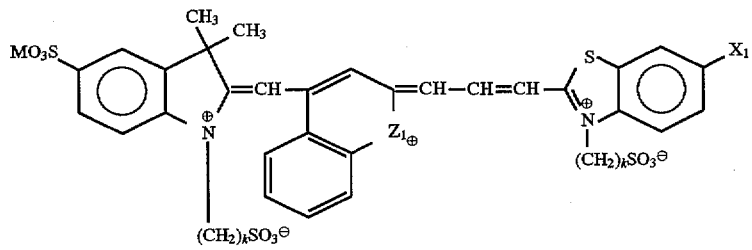

In the above-described specific examples, each substituent has the following meaning:

$Q_1$: —H, $—C_pH_{2p+1}$, $—(CH_2)_pCH=CH_2$, —CH=CH—$CH_3$,

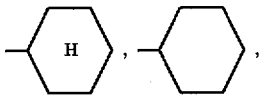

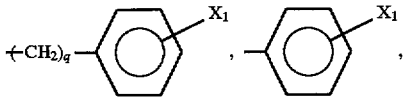

—COOH, —OH, —Cl, —Br, —CN, $—OC_pH_{2p+1}$,

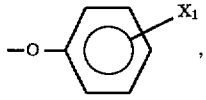

$—COOC_pH_{2p+1}$ p: an integer of from 1 to 12 q: an integer of from 1 to 3

$X_1$: the same meaning as $Q_1$ above, $—SO_2C_pH_{2p+1}$,

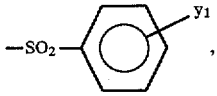

$—COC_pH_{2p+1}$, $—SC_pH_{2p+1}$, $—CONH_2$, $—CONHC_pH_{2p+1}$,

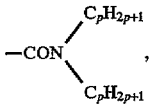

$—SO_2NHC_pH_{2p+1}$, $—SO_3M$, $—NO_2$, $—PO_3H_2$ (wherein $Y_1$ is —H, $—C_pH_{2p+1}$, —Cl, —Br, —F, —OH, $—OC_pH_{2p+1}$, $—COOC_pH_{2p+1}$, —CN (p is an integer of from 1 to 12))

M: —H, —Na, —K, $—H.N(C_2H_5)_3$,

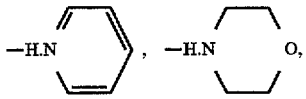

k: an integer of from 2 to 12

$b_1$: $—C_pH_{2p+1}$, $—(CH_2)_pCH=CH_2$, $—CH=CH—CH_3$,

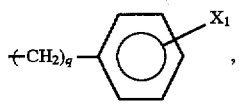

$—(CH_2)_p—X_2$, $—(CH_2CH_2O)_{r1}H$, $—(CH_2CH_2O)_{r1}C_pH_{2p+1}$, $—(CH_2CH_2O)_{r1}—(C_3H_6O)_{r2}H$, $—(C_3H_6O)_{r1}C_pH_{2p+1}$ wherein $X_2$: —OH, —Cl, —Br, —F, —CN, —COOH, $—COOC_pH_{2p+1}$, $—SO_3M$, $—PO_3H_2$, $r_1$, $r_2$: which may be the same or different, each represents an integer of from 1 to 6

$X_3$: $—SO_3^{\ominus}$, $—PO_3H^{\ominus}$ $X_3'$: $—SO_3M$, $—PO_3M_2$ $b_2$: —H, —$C_qH_{2q+1}$, —Cl, —Br,

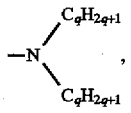

$d_1$, $d_2$: which may be the same or different, each represents —H, —$C_qH_{2q+1}$ $Z_1$: —O—, —S—

$d_3$: —$C_pH_{2p+1}$, —$C_6H_5$ $Z_2$: —Se—, —Te—

The above-described spectral sensitizing dyes for use in the present invention may be produced according to conventionally known methods, for example, the method described in JP-A-57-46245. Other various methods are described in F. M. Hamer, *The Cyanine Dyes and Related Compounds*, John Wiley & Sons, New York (1964).

As the electrically conductive support for use in the present invention, any of known water-absorptive supports used in this kind of electrophotosensitive material or electrophotographic lithographic printing plate may be used. Examples thereof include a substrate such as paper or plastic sheet, the substrate which has been subjected to electrically conductive treatment, for example, by impregnating it with a low resistance material, the above-described substrate having provided on the surface thereof a water-resistant adhesive layer or,at least one or more precoat layer, paper laminated with a plastic which has been made as an electrically conductive substrate by depositing Al or the like thereon, or paper or a plastic sheet laminated with an Al foil.

Specific examples of the electrically conductive substrate or electrically conductive material which can be used for the electrically conductive support used in the present invention include those described in Y. Sakamoto, *Denshishashin* (Electrophotography), 14, No. 1, pp. 2–11 (1975), H. Moriga, *Nyumon Tokusyu-shi no Kagaku* (Introduction on Chemistry of Special Paper), Kobunshi Kanko Kai (1975), M. F. Hover, *J. Macromol. Sci. Chem.*, A-4(6), pp. 1327–1417 (1970).

In the present invention, the surface of the support has a BEKK smoothness of 300 sec/10 cc or more. The BEKK smoothness as used herein means a value showing the smoothness of paper and the value can be determined by the BEKK smoothness tester. In the BEKK smoothness tester, a sample piece is pressed onto a highly smoothed circular glass plate with a hole at the center at a constant pressure (1 kg/cm$^2$) and the time required for a constant amount of air (10 cc) to pass between the glass surface and the paper under reduced pressure is measured.

In the present invention, the smoothness is preferably 500 sec/10 cc or more, more preferably 1,000 sec/10 cc or more.

In the present invention, the surface of an electrically conductive support means a surface to which a photosensitive layer is directly applied and for example, when an under layer or an overcoat layer, which will be described later, is provided on the support, the surface of the under layer or the overcoat layer is meant.

The smoothness may be set to fall within the above-described range by various conventionally known methods. Specific examples of the method include a method for achieving a BEKK smoothness on the surface of the support of 300 sec/10 cc or more by laminating the support surface with a resin or by calender reinforcement using a high-smoothness heat roller. Among these, a method by laminating the support surface with a resin is preferred.

More specifically, it is preferred that the electrically conductive support for use in the present invention has a resin layer in a thickness of 10 μm or more which is melt-bonded to the support and the surface of the support has a BEKK smoothness of 300 sec/10 cc or more. By satisfying these conditions, a support having a desired smoothness can be easily obtained and the image quality can be improved (the image comes to be in good sharpness: the line becomes smooth without jag).

Examples of the resin include polyethylene resins, polypropylene resins, acrylic resins, methacrylic resins, epoxy resins and copolymers of these. These resins may also be used in combination of two or more of these. Among these, preferred is polyethylene resins. Among the polyethylene resins, particularly preferred is a mixture of a low-density polyethylene and a high-density polyethylene. By using this resin, a uniformly coated film having excellent heat durability can be achieved. Further, by using this mixture resin, further superior electric conductivity can be achieved when an electrically conductive material which will be described later is added to the resin layer.

The low-density polyethylene preferably has a density of from 0.915 to 0.930 g/cc and a melt index of from 1.0 to 30 g/10 min and the high-density polyethylene preferably has a density of from 0.940 to 0,970 g/cc and a melt index of from 1.0 to 30 g/10 min. The blending ratio is preferably such that the low-density polyethylene is from 10 to 90% by weight and the high-density polyethylene is from 90 to 10% by weight.

It is preferred to incorporate an electron conductive material into the above-described resin layer so as to give a volume electric resistance of the finally obtained support of $10^{12}\Omega$ or less. By having such a volume electric resistance, the change of photographic properties due to the change in humidity (in particular, at the time of low humidity) can be inhibited, whereby an electrophotosensitive material excellent in the image quality or a lithographic printing plate having high printing durability can be stably obtained. Further, when the resin layer is provided on the surface of the support opposite to that having a photosensitive layer, development can be conducted by a direct feeding method which will be described layer, whereby the image obtained can have excellent uniformity of density and good sharpness.

Examples of the electron conductive material include colloidal alumina, colloidal silica, carbon black, a metal (e.g., Al, Zu, Ag, Fe, Cu, Mn, Co), a metal salt (e.g., chloride, bromide, sulfate, nitrate, oxalate of the metals described above) and a metal oxide (e.g., ZnO, $SnO_2$, $In_2O_3$).

As the conductive material, fine particles of a crystalline oxide or a composite oxide thereof or carbon black is preferably used (see, French Patent 2,277,136, U.S. Pat. No. 3,597,272). In particular, the electron conductive carbon black is advantageous because it can provide electrically conductive property with a small amount and also has good miscibility with the above-described resin.

The electron conductive material is used in such an amount that the support has a volume electric resistance of $10^{12}\Omega$ or less, more preferably from $10^3$ to $10^{11}\Omega$, furthermore preferably from $10_5$ to $10^{10}\Omega$. The use amount for giving such a resistance varies depending upon the kind of original paper, resin and electron conductive material and cannot be determined definitely, however, as a general standard, it is from 5 to 30% by weight based on the resin.

In the case when it is difficult to achieve the desired electric resistance by incorporating an electron conductive material into the resin layer, a resin layer having a resistance lower than the desired resistance may be provided and a thin overcoat layer having a high resistance may be provided thereon to obtain the volume resistance as a whole of a desired level of $10^{12}\Omega$ or less.

The volume electric resistance as used herein is measured by interposing a sample between two sheets of metal-made circular electrodes having a radius of 2.5 cm and reading the current value A upon application of a d.c. voltage V and determined according to the following equation:

Volume electric resistance Rv=V/A (Ω).

The volume electric resistance of the support is an element having an influence on the properties of the electrophotosensitive material and it is determined by the volume electric resistivity of the support and the thickness of the support. When the support of the present invention is a composite-type support, the volume electric resistance is determined by the volume electric resistivity of original paper, the volume electric resistivity of the electron conductive material-containing laminate layer and the thickness ratio therebetween and, therefore, it cannot be determined simply. Accordingly, the volume electric resistance of the support is expressed here by the resistance obtained according to the above-described measuring method.

The resin layer is coated on the surface of original paper to which the electrophotosensitive layer is applied or on both surfaces of original paper. The coating method thereof may be a conventionally known method for melt-bonding a resin.

In the present invention, the resin layer is preferably coated by an extrusion laminate method. By coating the resin layer by the extrusion laminate method, a lithographic printing plate having excellent image quality and printing durability can be provided. According to the extrusion laminate method, a resin is molten and shaped into a film, and immediately thereafter the film is pressure-bonded to original paper, followed by cooling to accomplish laminating, and various apparatuses are known therefor.

The thus-laminated resin layer has a thickness, in view of production stability, of 10 μm or more, preferably from 10 to 30 μm.

In order to increase the adhesive strength between original paper and the resin layer, it is preferred to coat the original paper previously with a polyethylene derivative such as an ethylene-vinyl acetate copolymer, an ethylene-acrylic ester copolymer, an ethylene-methacrylic ester copolymer, an ethylene-acrylic acid copolymer, an ethylene-methacrylic acid copolymer, an ethylene-acrylonitrile-acrylic acid copolymer or an ethylene-acrylonitrile-methacrylic acid copolymer or to subject the surface of original paper previously to corona discharge treatment. Other than these, the original paper may be subjected to surface treatment described in JP-A-49-24126, JP-A-52-36176, JP-A-52-121683, JP-A-53-2612, JP-A-54-111331 or JP-B-51-25337.

In the present invention, a back layer may be provided on the electrically conductive support. The back layer may have a structure conventionally known in this field. In particular, the back layer on the electrically conductive support has a surface resistivity of preferably $1\times10\Omega$ or less, more preferably $1\times10^4$ to $1\times10^8\Omega$, still more preferably from $1\times10^5$ to $1\times10^7\Omega$.

The surface resistivity as used here means a surface resistivity defined according to the description in JIS K 6911 (the term "JIS" as used herein means "Japanese Industrial Standard"). More specifically, it is determined by Model P-616 Measuring Electrode manufactured by Kawaguchi Denki Seisakusho KK or Universal Electrometer Model MMII-17A manufactured by Kawaguchi Denki Seisakusho KK.

In the present invention, the back layer may have any structure as long as the surface resistivity thereof is set to fall within the above-described range. The back layer may have a mono-layer structure or a multi-layer structure. The range of the surface resistivity of the back layer can be set, more specifically, by appropriately selecting the kind and amount of the electron conductive material and the kind and amount of various additives. Examples of the additive include various hydrophilic high polymers, water-resistant materials, water- and organic solvent-resistant materials and synthetic emulsions. The electron conductive material is the same as those described above to be incorporated into the resin layer and examples of other additives include those described later.

The use amount of this electron conductive material may be within a range that makes the back layer to have a surface resistivity falling within the above-described range. The use amount varies depending upon the kind of various additives and the electron conductive material and cannot be definitely specified by a specific numeral, however, as a general standard, it is from 5 to 30% by weight of the back layer.

In providing a layer of a resin such as polyethylene-based resin or polypropylene-based resin, slipping is readily caused and in order to prevent troubles in printing due to slipping from the printing drum at the printing, an overcoat layer may be provided on the back layer. The surface resistivity of the overcoat layer can be controlled to a desired value by adding, in addition to the electron conductive material contained in the resin layer, a surfactant as described below, a cationic high polymer electrolyte, an anionic high polymer electrolyte, a hydrophilic high polymer, a water-resistant material, a water and organic solvent-resistant material or a synthetic emulsion.

The thickness of the overcoat layer is not particulary restricted but preferably from 1 to 20 μm.

Examples of the surfactant include alkylphosphoric acid alkanol amine salt, polyoxyethylene alkylphosphate, polyoxyethylene alkyl ether, alkylmethyl ammonium salt, N,N-bis-(2-hydroxyethyl)alkylamine, alkylsulfonate, alkylbenzenesulfonate, fatty acid choline ester, polyoxyethylene alkyl ether or a phosphoric ester or salt thereof, fatty acid monoglyceride, fatty acid and sorbitan partial ester.

Examples of the cationic high polymer electrolyte include the following:

I. Ammonium

1. Primary, secondary or tertiary ammonium salt

Polyethyleneimine hydrochloride

Poly(N-methyl-4-vinylpyridium chloride)

2. Quaternary ammonium salt

Poly(2-methacryloxyethyltrimethylammonium chloride)

Poly(2-hydroxy-3-methacryloxypropyltrimethylammonium chloride)

Poly(N-acrylamidopropyl-3-trimethylammonium chloride)

Poly(N-methylvinylpyridinium chloride)

Poly(N-vinyl-2,3-dimethylimidazolinium chloride)

Poly(diallylammonium chloride)

Poly(N,N-dimethyl-3,5-methylenepiperidinium chloride)

II. Sulfonium

Poly(2-acryloxyethyldimethylsulfonium chloride)

III. Phosphonium

Poly(glycidyltributylphosphonium chloride)

Examples of the anionic high polymer electrolyte include the following:

I. Carboxylate

Poly(meth)acrylic acid

Polyacrylate hydrolysate

Polyacrylic acid amide hydrolysate

Polyacrylic acid nitrile hydrolysate

II. Sulfonate

Polystyrene sulfonate

Polyvinyl sulfonate

III. Phosphonate

Polyvinyl phosphonate

The hydrophilic high polymer for use in the present invention may be any known natural or synthetic hydrophilic high polymer. Specific examples thereof include water-soluble derivatives such as gelatin (e.g., conventional lime-processed gelatin, acid-processed gelatin, modified gelatin, derivative gelatin), albumin, sodium alginate, gum arabic, cellulose (e.g., cellulose, hydroxyethyl cellulose, carboxymethyl cellulose) and starch, and hydrophilic high polymers such as polyvinyl alcohol, polyvinylpyrrolidone, polyacrylamide and styrene-maleic anhydride copolymer, which may be used individually or in combination of two or more thereof. When hydrophilic colloid particles (obtained by forming a hydrophilic material such as silica ($SiO_2$), alumina ($Al_2O_3$) or zeolite into fine particles and stably dispersing the particles in a colloidal form) are added, the mechanical strength is further improved.

The water-resistant material includes a water-resistant film-forming material such as polyvinyl chloride, acrylic resin, polystyrene, polyethylene, alkyd resin, styrene-butadiene copolymer and ethylene-vinyl acetate copolymer, and an organic solvent-resistant film-forming material such as starch, oxidized starch, PVA, methyl cellulose, hydroxyethyl cellulose and CMC.

Examples of the water and organic solvent-resistant material include ethylene-vinyl alcohol copolymer, high polymerization degree polyester and high polymerization degree polyurethane. Also, a combination of starch, PVA, acrylic resin (reactive acrylic resin either of an organic solvent solution type or an O/W emulsion type) or alkyd resin (of air-curable type) with a crosslinking agent such as melamine resin may be used as a water and organic solvent-resistant material.

Examples of the synthetic emulsion include those obtained by emulsion-polymerizing or emulsion-copolymerizing a monomer or prepolymer such as acrylate, methacrylate, vinyl chloride, vinylidene chloride, vinyl acetate, polyurethane, acrylonitrile, butadiene or styrene-butadiene.

In the present invention, an under layer may be provided, if desired, between the electrically conductive support and the electrophotosensitive layer. The under layer has a surface resistivity of preferably from $1\times10^{8}$ to $1\times10^{14}\Omega$, more preferably from $1\times10^{8}$ to $1\times10^{13}\Omega$, still more preferably from $1\times10^{8}$ to $1\times10^{12}\Omega$. By setting the surface resistivity of the under layer to fall within the above-described range, generation of a pin hole, i.e., an area where the toner is not transferred due to spark marks formed upon electric discharge can be prevented and also, generation of fog can be inhibited. The under layer of the present invention may have any structure as long as the surface resistivity thereof can fall within the above-described range. The range of the surface resistivity of the under layer may be controlled in practice by appropriately selecting the kind and amount of the electron conductive material and the kind and amount of various additives. Examples of the additive include various water-resistant materials, water and organic solvent-resistant materials and synthetic emulsions. Examples of the electron conductive material and various additives include those described above for the back layer and those described later.

The use amount of the electron conductive material in the under layer may be within a range that makes the under layer to have a surface resistivity falling within the above-described range. The use amount varies depending upon the kind of various additives and the electron conductive material and cannot be definitely specified by a specific numeral, however, as a general standard, it is from 0 to 20% by weight of the under layer.

The materials for the back layer and the under layer may be used in combination. Also, if desired, a dispersant, a leveling agent and a crosslinking agent may be added.

Further, adhesion of the back layer or the under layer can be improved by adding thereto a hydrophilic high polymer binder, for example, an organic titanium compound.

In the present invention, the back layer may have any thickness as long as the capabilities of the layer can be exerted. More specifically, the total thickness of the back layer is generally from 1 to 25 μm, preferably from 5 to 15 μm. Also, the thickness of the under layer is from 1 to 25 μm, preferably from 5 to 15 μm.

Examples of the inorganic photoconductor for use in the image formation method of the present invention include zinc oxide, titanium oxide, zinc sulfide, cadmium sulfide, zinc selenide, cadmium selenide and lead sulfide. The photoconductor may of course be a photoconductor processed as described in H. Miyamoto and H. Takei, *Imejingu* (Imaging), 1973 (No. 8).

As the chemical sensitizer for use in the present invention, any compound known as a chemical sensitizer of an inorganic photoconductor may be used and the compounds may be used individually or in combination of two or more.

A conventionally known chemical sensitizer of a photoconductive zinc oxide or titanium oxide is an electron-accepting compound (or electron affinitive compound) and specific examples thereof include the compounds described in publications or general remarks such as H. Miyamoto and H. Takei, *Imejingu* (Imaging), No. 8, pp. 6 and 12 (1973), H. Kiess, *Progress in Surface Science,* 9, 113 (1979), I. Shinohara, *Kiroku Zairyo to Kankosei Jushi* (Recording Material and Photosensitive Resin), Chap. 3, Gakkai Shuppan Center KK (1979), E. Inoue, *Kagaku to Kogyo* (Chemistry and Industry), 23, 158 (1970).

More specifically, examples of the compound include a quinone (e.g., benzoquinone, chloranil, fluoranil, bromanil, anthraquinone, 2-methylanthraquinone, 2,5-dichlorobenzoquinone, 2-sulfobenzoquinone, 2-butylquinone, 2,5-dimethylbenzoquinone, 2,3-dichloro-5,6-dicyanobenzoquinone, 2-methanesulfonylbenzoquinone), a cyano group or nitro group-containing compound (e.g., nitrobenzene, dinitrobenzene, dinitrofluorenone, trinitrofluorenone, tetracyanoethylene, nitronaphthalene, dinitronaphthalene, nitrophenol, cyanophenol, dinitrophenol, dicyanophenol), an aliphatic carboxylic acid which may contain a substituent (e.g., lauric acid, stearic acid, linoleic acid, linolenic acid, fumaric acid, maleic acid, adipic acid, glutaric acid, malic acid, lactic acid, tartaric acid, trichloroacetic acid, dichloroacetic acid, chloropropionic acid, dimethylmaleic acid, chloromaleic acid, dichloromaleic acid, chlorofumaric acid, phenylpropionic acid, amino acid), an aromatic carboxylic acid (e.g., benzoic acid, phthalic acid, pyromellitic acid, mellitic acid, naphthalenecarboxylic acid, 3,3',4,4'-benzophenonetetracarboxylic acid, a carboxylic acid further containing other substituent (examples of the substituent include a hydroxy group, a mercapto group, a halogen atom, a cyano group, a nitro group, a trifluoromethyl group, an alkyl group, an alkoxy group, a phenoxy group, an acyl group, an acetamido group, a methanesulfonyl group, an alkoxycarbonyl group, an amino group and a plurality of substituents, which may be the same or different, may be contained)), an organic acid cyclic acid anhydride (examples of the organic acid cyclic anhydride include a cyclic anhydride of an aliphatic dicarboxylic acid which may be substituted (e.g., succinic anhydride, 2-methylsuccinic anhydride, 2-ethylsuccinic anhydride, 2-butylsuccinic anhydride, 2-octylsuccinic anhydride, decylsuccinic anhydride, 2-dodecylsuccinic anhydride, 2-octadecylsuccinic anhydride, maleic anhydride, methylmaleic anhydride, dimethylmaleic anhydride, phenylmaleic anhydride, chloromaleic anhydride, dichloromaleic anhydride, fluoromaleic anhydride, difluoromaleic anhydride, bromomaleic anhydride, itaconic anhydride, citraconic anhydride, glutaric anhydride, adipic anhydride, diglycolic anhydride, pimelic anhydride, suberic anhydride, cie-5-norbornene-endo-2,3-dicarboxylic acid, d-campholinic anhydride, 3-oxabicyclo-[3,2,2]nonane-2,4-dione, 1,3-dioxorane-2,4-dione) and an α-amino acid-N-carboxylic anhydride (examples of the α-amino acid as a starting material include glycine, N-phenolglycine, alanine, β-phenylalanine, valine, leucine, isoleucine, α-aminophenylacetic acid, α-aminocaprylic acid, α-aminolauric acid, γ-benzylglutamic acid, sarcosine)) and an aromatic cyclic acid anhydride (e.g., phthalic anhydride, nitrophthalic anhydride, dinitrophthalic anhydride, methoxyphthalic anhydride, methylphthalic anhydride, chlorophthalic anhydride, cyanophthalic anhydride, dichlorophthalic anhydride, tetrachlorophthalic anhydride, tetrabromophthalic anhydride, O-sulfobenzoic anhydride, 3,3',4,4'-benzophenonetetracarboxylic dianhydride, phthalonic anhydride, pyromellitic anhydride, mellitic anhydride, pulvinic anhydride, diphenic anhydride, thiophenedicarboxylic anhydride, furanedicarboxylic anhydride, 1,8-naphthalenedicarboxylic anhydride, pyrroledicarboxylic anhydride).

Further, N-hydroxyimido compounds described in JP-A-3-136061, acylhydrazone derivatives, triazole derivatives, imidazolone derivatives, imidathione derivatives and benzimidazole derivatives described in JP-A-51-124933, amido compounds having a specific structure described in JP-A-58-102239, polyarylalkane compounds, hindered phenol compounds and p-phenylenediamine compounds described in general remarks of H. Kokado et al., *Saikin no Hikaridoden Zairyo to Kankotai no Kaihatsu•Jitsuyoka* (Recent Developments and Practical Use of Photoconductive Material and Photosensitive Material), Chaps. 4 to 6, Nippon Kagaku Joho KK, Shuppan-bu (1986), and compounds described in JP-A-58-65439, JP-A-58-129439 and JP-A-62-71965 are included.

In the present invention, a plasticizer may be added to the electrophotosensitive layer and examples of the plasticizer include dimethyl phthalate, dibutyl phthalate, dioctyl phthalate, triphenyl phthalate, triphenyl phosphate, diisobutyl adipate, dimethyl sebacate, dibutyl sebacate, butyl laurate, methylphthalylethyl glycolate and dimethylglycol phthalate. The plasticizer may be added to improve flexibility of the electrophotosensitive layer. The plasticizer may be added in such an amount that the electrostatic properties of the electrophotosensitive layer is not deteriorated.

The binder resin which can be used in the electrophotosensitive layer of the present invention may be any known resin conventionally used in the electrophotosensitive material. The weight average molecular weight of the resin is preferably from $5\times10^3$ to $1\times10^6$, more preferably from $2\times10^4$ to $5\times10^5$. The glass transition point of the binder resin is preferably from −40° to 200° C., more preferably from −10° to 140° C.

Examples of the known binder resin for use in the electrophotosensitive layer include compounds described in publications or general remarks such as R. Shibata and J. Ishiwatari, *Kobunshi* (High Molecular Material), Vol. 17, p. 278 (1968); H. Miyamoto and H. Takei, *Imejingu* (Imaging), 1973 (No. 8); K. Nakamura (compiler), *Kiroku Zairyo yo Binder no Jissai Gijutsu* (Practical Technique of Binder for Recording Material), Chap. 10, C. M. C. Shuppan (1985); *Denshi-shashin yo Yuki Kankotai no Genjo Simpojiumu Yokoshu* (Symposium on Organic Photosensitive Material for Electrophotography, Minute Collection), Denshi-shashin Gakkai (compiler) (1985); H. Kokado (compiler), *Saikin no Hikaridoden Zairyo to Kankotai no Kaihatsu•Jitsuyoka*, Nippon Kagaku Joho KK (1986); *Denshi-shashin Gijutsu no Kiso to Oyo* (Basic and Application of Electrophotograph Technology), Chap. 5, Denshi-shashin Gakkai (compiler), Corona Sha KK (1988); D. Tatt and S. C. Heidecker, *Tappi*, 49 (No. 10), 439 (1966); E. S. Baltazzi, R. G. Blanclotteet et al., *Phot. Sci. Eng.*, 16 (No. 5), 354 (1972); and Guene Chan Cay, I. Shimizu and E. Inoue, *Denshi-shashin Gakkai Shi*, 18 (No. 2), 22 (1980).

Specific examples of the binder resin include an olefine polymer or copolymer, a vinyl chloride copolymer, a vinylidene chloride copolymer, an alkane acid vinyl polymer or copolymer, an alkane acid allyl polymer or copolymer, a polymer or copolymer of styrene or a derivative thereof, a butadiene-styrene copolymer, an isoprene-styrene copolymer, a butadiene-unsaturated carboxylate copolymer, an acrylonitrile copolymer, a methacrylonitrile copolymer, an alkyl vinyl ether copolymer, an acrylate polymer or copolymer, a methacrylate polymer or copolymer, a styrene-acrylate copolymer, a styrene-methacrylate copolymer, an itaconic acid diester polymer or copolymer, a maleic anhydride copolymer, an acrylamido copolymer, a methacrylamido copolymer a hydroxyl group-modified silicone resin, a polycarbonate resin, a ketone resin, a polyester resin, a silicone resin, an amido resin, a hydroxyl group- and carboxyl group-modified polyester resin, a butyral resin, a polyvinylacetal resin, a cyclized rubber-methacrylate copolymer, a cyclized rubber-acrylate copolymer, a copolymer containing a nitrogen-free heterocyclic ring (examples of the heterocyclic ring include a furan ring, a tetrahydrofuran ring, a thiophene ring, a dioxane ring, a dioxofuran ring, a lactone ring, a benzofuran ring, a benzothiophene ring and a 1,3-dioxetane ring) and an epoxy resin.

More specifically, conventionally known resins described in T. Endo, *Netsukokasei Kobunshi no Seimitsuka* (Precisionize of Heat-curable Polymer), CMC. KK (1986), Y. Harasaki, *Saishin Bainda Gijutsu Binran* (Newest Binder Handbook), Chap. II-1, Sogo Gijutsu Center (1985), T. Ohtsu, *Akuriru Jushi no Gosei•Sekkei to Shin-yoto Kaihatsu* (Synthesis, Design and Development of New Application of Acryl Resin), Chubu Keiei Kaihatsu Center Shuppan-bu (1985) and E. Ohmori, *Kinousei Akuriru Kei Jushi* (Functional Acryl Resins), Technosystem (1985) may be used.

In particular, when a resin containing an acidic group such as a carboxyl group, a sulfo group or a phosphono group and having a relatively low molecular weight (approximately from $10^3$ to $10^4$) is used as the binder resin in the electrophotosensitive layer, the electrostatic characteristics can be improved. Examples of the resin include a resin comprising acidic group-containing polymer components randomly present in the polymer main chain as described in JP-A-63-217354, a resin comprising an acidic group bonded to one terminal of the polymer main chain as described in JP-A-64-70761, a resin comprising an acidic group bonded to the main chain terminal of a graft-type copolymer and a resin containing an acidic group in the graft moiety of a graft-type copolymer as described in JP-A-2-67563, JP-A-2-236561, JP-A-2-238458, JP-A-2-236562 and JP-A-2-247656 and an A-B type block copolymer containing an acidic group as block described in JP-A-3-181948.

Further, in order to achieve sufficiently high mechanical strength of the electrophotosensitive layer which may not be available only by the above-described low molecular weight resin, other resin having a middle or high molecular weight is preferably used in combination. Examples of such a resin include a thermosetting resin having a cross-linking structure formed between polymers as described in JP-A-2-68561, a resin partly having a cross-linking structure as described in JP-A-2-68562 and a resin comprising an acidic group bonded to the main chain terminal of a graft-type copolymer as described in JP-A-2-69759. Further, by using a specific middle or high molecular weight resin, properties can be maintained stably even when the environment changes greatly. Examples of the resin include a resin comprising an acidic group bonded to the terminal of the graft moiety of a graft-type copolymer and a resin having an acidic group in the graft moiety of a graft-type copolymer as described in JP-A-3-29954, JP-A-3-77954, JP-A-3-92861 and JP-A-3-53257 and a graft-type copolymer containing an A-B block-type copolymer consisting of A block containing an acidic group and B block containing no acidic group in the graft moiety as described JP-A-3-206464 and JP-A-3-223762. By using the specific resin, the photoconductor can be dispersed uniformly, the electrophotosensitive layer having good smoothness can be formed and, further, excellent electrostatic properties can be maintained even when the environment changes.

In general, the amount of the binder resin to be incorporated into the composition for the electrophotosensitive layer of the present invention can be changed, and typically it is from about 10 to about 90% by weight, preferably from 15 to 60% by weight, based on the total amount of the mixture of the photoconductive material and the resin.

The sensitizing dye may be used in the present invention with reference to any conventionally known method. In particular, advantageous methods include a method where a photoconductor is dispersed in a binder resin and a dye solution is added thereto and a method where a photoconductor is previously poured in a dye solution to be adsorbed to the dye and the solution is then dispersed in a binder resin. The use amount of the sensitizing dye in the present invention varies over a wide range in view of the level of sensitivity required. Namely, the sensitizing dye may be used in an amount of from 0.0005 to 2.0 parts by weight per 100 parts by weight of the photoconductor and it is preferably used in an amount of from 0.001 to 1.0 part by weight per 100 parts by weight of the photoconductor.

The chemical sensitizer may be used in the present invention according to any of a method where a powder or solution of the chemical sensitizer is used together with the above-described sensitizing dye, a method where it is added before adding the dye and a method where a photoconductor is previously mixed with the chemical sensitizer and a binder and/or dye is added and dispersed therein, but a method where a photoconductor and a chemical sensitizer are previously processed is preferred.

The use amount of the chemical sensitizer in the present invention may be from 0.0001 to 1.0 part by weight per 100 parts by weight of the photoconductor. If it is less than this range, effects cannot be provided on the electrostatic charge property, the dark-charge retentivity and the sensitizing property, whereas if it exceeds the range, an apparent sensitivity is increased but the dark-charge receptive property is reduced remarkably.

The sensitizing dyes and the chemical sensitizing dyes for use in the present invention can be incorporated into the photosensitive layer individually or in combination of two or more thereof. Further, although the sensitizing dye of the present invention is spectrally sensitized to near infrared or infrared light, it is of course possible to use a conventionally known spectral sensitizing dye for visible light (e.g., Fluorescene, Rose Bengal, Rhodamine B, cyanine dyes such as monomethine, trimethine and pentamethine or merocyanine dyes) in combination depending upon the purpose.

When conventionally known various additives for the electrophotosensitive layer are further used, the addition amount may be freely selected as long as the effect of the present invention is not inhibited, however, it is usually from 0.0005 to 2.0 parts by weight per 100 parts by weight of the photoconductor.

As an organic solvent used in dispersion, a volatile hydrocarbon solvent having a boiling point of 200° C. or lower is used and in particular, a hydrocarbon halide having from 1 to 3 carbon atoms such as dichloromethane, chloroform, 1,2-dichloroethane, tetrachloroethane, dichloropropane or trichloroethane is preferred. In addition, various solvents for use in coating compositions such as an aromatic hydrocarbon (e.g., chlorobenzene, toluene, xylene, benzene), a ketone (e.g., acetone, 2-butanone), an ether (e.g., tetrahydrofuran) and a methylene chloride or a mixture with the above-mentioned solvent(s) can be used. The solvent is added in an amount of from 1 to 100 g, preferably from 5 to 20 g, per 1 g of the total amount of the dye, the photoconductive material and other additives.

The coating thickness of the composition for the electrophotosensitive layer may be varied over a wide range. The composition may be usually coated in a thickness (before drying) of from about 10 to about 300 μm, but the coating thickness before drying is preferably from about 50 to about 150 μm. However, even if the thickness is outside this range, an effective result may be obtained. The dry thickness of the coating is sufficient if it is within the range of from about 1 to about 50 μm.

The electrophotosensitive layer composition for use in the present invention can be used not only as a photosensitive layer (photoconductive layer) of a monolayer-type electrophotosensitive material but also as a charge carrier generation layer of a function separated-type electrophotosensitive material comprising two layers, i.e., a charge carrier generation layer and a charge carrier transportation layer or as a photoconductive photosensitive particle or a photoconductive composition to be contained therein in photoelectrophoretic electrophotography.

When the electrophotosensitive layer is used as a charge generation layer of a multilayer-type photosensitive material comprising a charge generation layer and a charge transportation layer, the thickness of the charge generation layer is preferably from 0.01 to 5 μm, more preferably from 0.05 to 2 μm.

The electrophotosensitive material of the present invention described in the foregoing is processed into a lithographic printing plate through usual steps such as electrostatic charging, imagewise exposure and development. Further, the material is suitable for the development in a direct feeding system which will be described later.

The imagewise exposure applied to the present invention is beam exposure. In particular, laser beam-scanning exposure is preferred.

In the present invention, the laser beam recording is conducted by converging laser beams emitted from a gas laser such as He—Cd or He—Ne or a semiconductor laser such as GaAlAs through an fθ lens, forming a scanning image on a photosensitive material by means of a polygon mirror and developing and, if desired, transferring the image. In case of a gas laser, it is necessary to use a light modulator, whereas the semiconductor laser is advantageous in that it is compact and lightweight as compared with the gas laser and requires no modulator, thus, the semiconductor laser is being used in practice. However, the GaAlAs semiconductor laser in practical use emits laser beams having an oscillation wavelength of about 780 nm and accordingly, the electrophotosensitive layer composition used must be sensitive to laser beams of this wavelength.

In laser beam scanning recording, when plane scanning is conducted by deflecting laser beams using a rotary mirror, the scanning speed becomes a function of the polarizing angle thereby causing distortion in printing and accordingly, an fθ lens or the like is used in the optical system to improve linearity. It is also possible to use a polygon mirror having curvature on the reflecting surface in place of the fθ lens so as to eliminate the scanning distortion. Other scanning methods may be used, for example, a method where the mirror is moved in parallel or a method where a plurality of mirrors are used may be employed.

In the present invention, the development may be made by any wet development method, however, it is preferred to use the method of the present invention based on the principle view of a direct feeding system shown in FIG. 1.

In this development method, as shown in FIG. 1, a conductor 1 is brought into contact with the surface 2 of a back layer, the surface 3 of an electrophotosensitive layer is put to face an electrode 4, a voltage is applied between the electrode 4 and the conductor 1 in the manner that the electrode 4 and the conductor 1 respectively become a positive electrode and a negative electrode, and the positive charge on the surface 2 of the back layer is swiftly neutralized according to the necessity by electrons directly fed from the conductor 1 or an earth 5 and, as a result thereof, the toner (+) is smoothly attached to the electrophotosensitive layer 3 (−) and then neutralized.

Due to this action, a so-called solid image can be completely free of area where the toner is not attached, whereby a more uniform solid image can be obtained and the development speed can be expedited.

The present invention will be described below in greater detail by referring to the Examples, however, the present invention should not be construed as being limited thereto.

EXAMPLES 1 TO 4 AND COMPARATIVE EXAMPLES 1 AND 2

Preparation of Electrophotosensitive material:

Composition A for an under layer or a back layer was prepared according to the following formulation (1):

Formulation (1)

| | |
|---|---|
| SSR Latex (50 wt % water dispersion) | 92 parts by weight |
| Clay (45 wt % water dispersion) | 110 parts by weight |
| Melamine (80 wt % aqueous solution) | 5 parts by weight |
| Water | 191 parts by weight |

A wood free paper having a basis weight of 100 g/m$^2$ was used as a support and one side thereof was coated with the above-described Composition A having added thereto 10.0 parts by weight of carbon black so as to give a dry coating amount of 10 g/m$^2$ to form thereby an under layer (surface resistivity: $4\times10^{10}\Omega$). Then, the surface of the support opposite to the under layer was coated with Composition A having added thereto 25.0 parts by weight of carbon black so as to give a dry coating amount of 10 g/m$^2$ to form thereby a back layer (surface resistivity: $3\times10^{7}\Omega$). Thereafter, the laminate was calendered using a calendering roller capable of changing the temperature and the pressure to obtain electrically conductive supports varied in the BEKK smoothness on the surface of the under layer by 6 stages as shown in Table 1 below. The BEKK smoothness was here determined using a BEKK smoothness testing apparatus manufactured by Kumagai Riki Kogyo KK.

The under layer surface of respective supports was coated with a composition for the electrophotosensitive layer prepared according to the following formulation (2) so as to give a dry coating weight of 30 g/m$^2$ to obtain thereby various electrophotosensitive materials.

Formulation (2)

| | |
|---|---|
| Photoconductive zinc oxide (SAZEX 2000 produced by Sakai Kagaku Kogyo KK) | 100 parts by weight |
| Binder Resin (B-1) shown below | 20 parts by weight |
| Binder Resin (B-2) shown below | 4 parts by weight |
| Phthalic anhydride | 0.2 part by weight |
| Sensitizing Dye (S-1) shown below | 0.02 part by weight |
| Fluorescein | 0.2 part by weight |
| Methanol | 10 parts by weight |
| Toluene | 150 parts by weight |

Binder Resin (B-1)

[Kall]

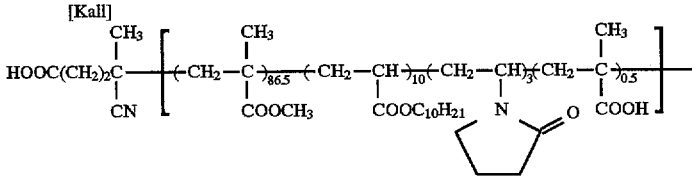

Mw 8 × 10$^4$ (by weight)

-continued

Binder Resin (B-2)

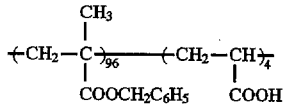

Mw $7\times10^3$

Sensitizing Dye (S-1)

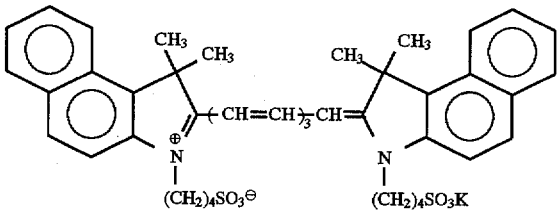

The thus-obtained six kinds of electrophotosensitive materials were evaluated for their capabilities as follows.

Each electrophotosensitive material was subjected to corona charging at −6 kV and, after holding it in the dark for 60 seconds, to imagewise exposure using a gallium-aluminum-arsenic semiconductor laser beams (oscillation wavelength: 780 nm). The imagewise exposure was conducted using an original having a line in a width of 50 μm and a length of 3 cm at the center thereof so as to examine the sharpness. After the image exposure, each electrophotosensitive material was wet-developed using the toner developing device of a plate-making apparatus ELP-330X manufactured by Fuji Photo Film Co., Ltd.

Six kinds of samples were evaluated for their sharpness of a 50 μm-width line resulting from respective optimum exposure (plate-making at an exposure index capable of most faithfully reproducing the line width of a 50 μm-width line) based on the following criteria (the results can be a basis for determination of the letter or halftone image quality).

A: The line was completely free of break in the length of 3 cm.

B: The line had from 0 to 3% break in the length of 3 cm.

C: The line had from 4 to 10% break in the length of 3 cm.

D: The line had 10% or more break in the length of 3 cm.

The results are shown in Table 1.

TABLE 1

| | Smoothness of Under Layer (sec/10 cc) | Sharpness |
|---|---|---|
| Comparative Example 1 | 80 | D |
| Comparative Example 2 | 210 | C |
| Example 1 | 310 | B |
| Example 2 | 600 | A |
| Example 3 | 1,020 | A |
| Example 4 | 2,010 | A |

From the results in Table 1, it is seen that samples in Examples 1 to 4 of the present invention were excellent in the sharpness of line work and good in the image quality of letters or halftone images as compared with samples in comparative examples.

EXAMPLES 5 TO 8 AND COMPARATIVE EXAMPLES 3 AND 4

A wood free paper having a basis weight of 100 g/m$^2$ was coated with a 5% aqueous solution of calcium chloride (20 g/m$^2$) and then dried to obtain an electrically conductive original paper. Both surfaces of the paper were coated with an aqueous latex of an ethylene-methyl acrylate-acrylic acid copolymer (molar ratio: 65:30:5) to give a dry coating amount of 0.2 g/m$^2$ and dried and then, both surfaces of the original paper were laminated with pellets obtained by roast-melting and kneading 70% of a low-density polyethylene having a density of 0.920 g/cc and a melt index of 5.0 g/10 min, 1.5% of a high-density polyethylene having a density of 0.950 g/cc and a melt index of 8.0 g/10 min and 15% of electrically conductive carbon by an extrusion method to give a thickness of 25 μm on each surface to obtain thereby a support having thereon polyethylene layers in a uniform thickness. The resulting support had a volume electric resistance of $1\times10^8\Omega$. Thereafter, a heating and pressure roller grained to various degrees was pressed to the surface of the support on the side where an electrophotosensitive layer was to be coated to form six kinds of surfaces different in the BEKK smoothness as shown in Table 2. Subsequently, each of the polyethylene layer surfaces to be coated by an electrophotosensitive layer and which were differentiated in the smoothness was subjected to corona discharge treatment under conditions of 5 kVA•sec/m$^2$ and coated with a coating solution having the following composition to give a dry coating amount of 20 g/m$^2$ and dried to provide thereby an electrophotosensitive layer. There was no trouble of adhesion to a pass roller due to softening of the polyethylene layer even when the layer was dried at a drying temperature of 100° C. for 1 minute.

| | |
|---|---|
| Photoconductive zinc oxide (SAZEX 2000 produced by Sakai Kagaku Kogyo KK) | 100 parts |
| Binder Resin (B-3) shown below | 17 parts |
| Binder Resin (B-4) shown below | 3 parts |
| Sensitizing Dye (S-2) shown below | 0.015 part |
| Maleic anhydride | 0.10 part |
| Salicylic acid | 0.12 part |
| Methanol | 10 parts |
| Toluene | 150 parts |

Binder Resin (B-3)

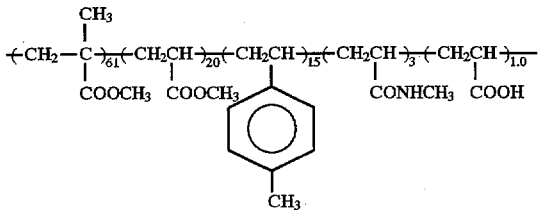

Mw $7 \times 10^4$

Binder Resin (B-4)

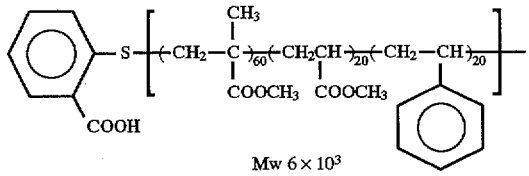

Mw $6 \times 10^3$

Sensitizing Dye (S-2)

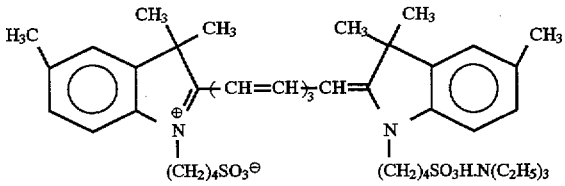

Each of the thus-obtained electrophotosensitive materials was allowed to stand in the dark at 25° C. and 65% RH for 12 hours and then subjected to electrostatic charging and to imagewise exposure in the same manner as in Example 1.

Each electrophotosensitive material was processed into a plate using the toner developing device of a plate-making apparatus ELP-330X (manufactured by Fuji Photo Film Co., Ltd.) with a direct feeding system as shown in FIG. 1.

The sharpness was evaluated in the same manner as in Example 1.

Further, the solid image density was evaluated based on the following criteria. The imagewise exposure was conducted using an original having pasted on the center thereof a black sheet in a size of 185 mm×257 mm (B5 size) so as to examine the uniformity of the solid image. The resulting samples were measured on the solid image density by means of a Macbeth densitometer and evaluated on the uniformity as follows.

A: The difference in density between the maximum density part and the minimum density part was 0.05 or less.

B: The difference in density between the maximum density part and the minimum density part was from 0.06 to 0.99.

C: The difference in density between the maximum density part and the minimum density part was 1.00 or more.

The results obtained are shown in Table 2 below.

TABLE 2

| | Smoothness of Under Layer (sec/10 cc) | Uniformity of Solid Image | Sharpness |
|---|---|---|---|
| Comparative Example 3 | 50 | A | D |
| Comparative Example 4 | 205 | A | C |
| Example 5 | 330 | A | B |
| Example 6 | 590 | A | A |
| Example 7 | 1,105 | A | A |
| Example 8 | 1,950 | A | A |

As seen in Table 2, samples in Examples 5 to 8 each having a BEKK smoothness according to the present invention showed good results in the solid image uniformity and also in the sharpness. Samples in Comparative Examples 3 and 4 were bad in the sharpness and, even though laminated, samples having a low smoothness failed in achieving good sharpness. Further, it is seen that good results could be obtained by a direct feeding system.

Further, in spite of the passing through a panel heater-type toner heat-fixing zone (90° C., 10 sec) in print making, absolutely no blister was generated.

Each plate was subjected to degreasing treatment with an etching solution (produced by Andolethograph Multigraph) and printing was conducted thereon in an off-set printing apparatus Hamastar 700. As a result, 10,000 or more printed materials having good image quality reproducing the solid image uniformity and thin line sharpness achieved on the plate were obtained.

EXAMPLES 9 AND 10 AND COMPARATIVE EXAMPLES 5 TO 14

Electrophotosensitive materials of Examples 9 and 10 and Comparative Examples 5 to 8 were prepared in the same manner as in Example 1 except for using Sensitizing Dye (S-3) shown below in place of Sensitizing Dye (S-1) used in Example 1 and using supports of respective examples and comparative examples as shown in Table 3.

Electrophotosensitive materials of Comparative Examples 9 to 14 were prepared in the same manner as in Example 1 except for using Sensitizing Dye (A) shown below in place of Sensitizing Dye (S-1) used in Example 1 and using supports of respective comparative examples as shown in Table 3.

Sensitizing Dye (S-3)

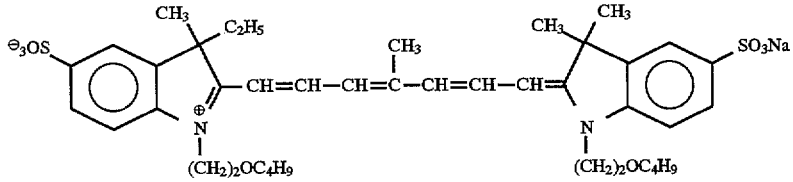

-continued

Sensitizing Dye (A)

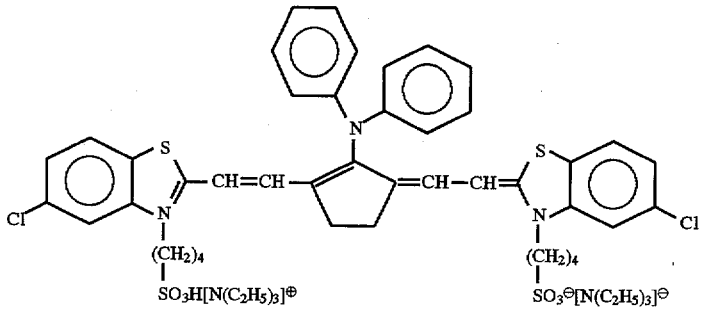

Each sample was electrostatically charged, subjected to image exposure and processed into a plate in the same manner as in Example 1 using the toner developing device of a plate-making apparatus ELP-330X (manufactured by Fuji Photo Film Co., Ltd.) with a direct feeding system. However, in these examples and comparative examples, the surface voltage after electrostatic charging was set to −550 V, the laser power was varied in accordance with the exposure amount $E_{90}$ necessary for giving an electric potential of −55 V, determined from the electrophotographic properties, and the scanning speed was the same to effect image exposure under optimal exposure conditions.

The resulting processed plates were evaluated for their sharpness and the solid image uniformity in the same manner as in Example 5. The results obtained are shown in Table 3 below.

TABLE 3

| | Sensitizing Dye | Support | Smoothness of Under Layer (sec/10 ml) | Solid Image Uniformity | Sharpness |
|---|---|---|---|---|---|
| Example 9 | (S-3) | Example 2 | 600 | A | A |
| Example 10 | " | Example 6 | 590 | A | A |
| Comparative Example 5 | " | Comparative Example 1 | 80 | A | D |
| Comparative Example 6 | " | Comparative Example 2 | 210 | A | C |
| Comparative Example 7 | " | Comparative Example 3 | 50 | A | D |
| Comparative Example 8 | " | Comparative Example 4 | 205 | A | C |
| Comparative Example 9 | (A) | Comparative Example 1 | 80 | C | D |
| Comparative Example 10 | " | Comparative Example 2 | 210 | C | D |
| Comparative Example 11 | " | Example 2 | 600 | B | D |
| Comparative Example 12 | " | Comparative Example 3 | 50 | C | D |
| Comparative Example 13 | " | Comparative Example 4 | 205 | C | D |
| Comparative Example 14 | " | Example 6 | 590 | B | D |

As seen from the results in Table 3, samples of Examples 9 and 10 using a sensitizing dye of the present invention and having a smoothness of the support within the scope specified in the present invention were good in the solid image uniformity and the sharpness. On the contrary, samples of Comparative Examples 5 to 14 using a sensitizing dye other than those of the present invention or having a smoothness of the support outside the scope specified in the present invention failed to provide good results in the solid uniformity and the sharpness at the same time.

EXAMPLES 11 TO 14

Electrophotosensitive materials of Examples 11 to 14 were prepared by coating a support prepared in the manner of Example 1 except that the under layer was prepared to have a smoothness of 600 sec/10 cc with the following composition for the electrophotosensitive layer to give a dry coating amount of 26 g/m$^2$.

Formulation of Photosensitive Layer Composition

| | |
|---|---|
| Photoconductive zinc oxide (SAZEX 2000) | 100 parts |
| Binder Resin (B-5) shown below | 16 parts |
| Binder Resin (B-6) shown below | 4 parts |

-continued

| | |
|---|---|
| Sensitizing dye shown in Table 4 below | $1.2 \times 10^{-5}$ part by mol |
| Chemical sensitizer shown in Table 4 below | see Table 4 |

Binder Resin (B-5)

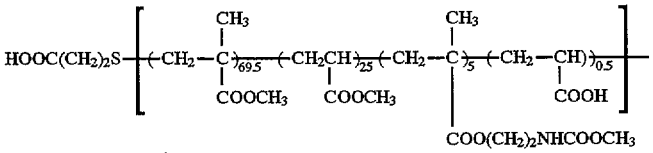

Mw $8 \times 10^4$

Binder Resin (B-6)

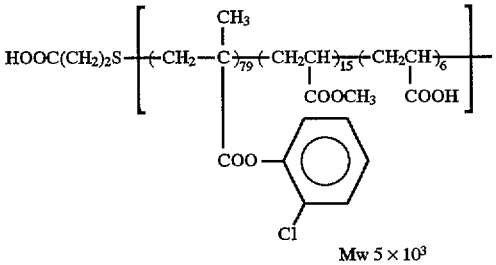

Mw $5 \times 10^3$

TABLE 4

| Example | Sensitizing Dye (S) | Chemical Sensitizer | |
|---|---|---|---|
| 11 | 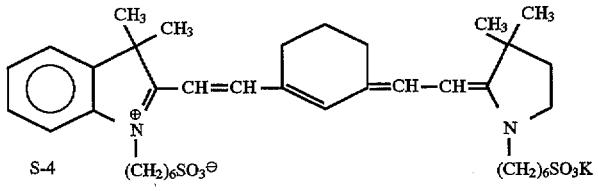 S-4 | N-Hydroxyphthalimido | 0.2 part |
| 12 | 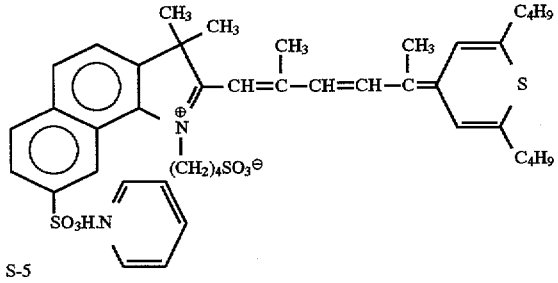 S-5 | Thiosalicylic acid<br>2-Methylmaleic anhydride | 0.1 part<br>0.15 part |
| 13 | 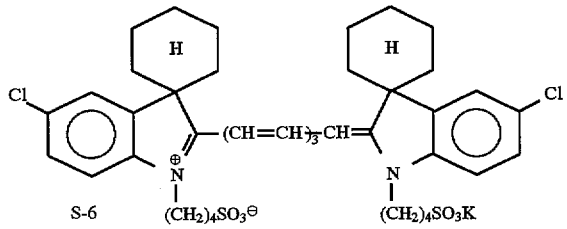 S-6 | N-Hydroxymaleinimido | 0.18 part |
| 14 | 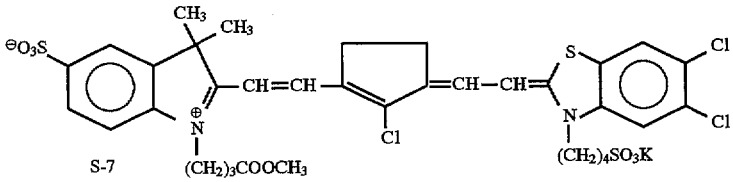 S-7 | Pyromellitic anhydride<br>o-Anisic acid | 0.15 part<br>0.2 part |

When the photosensitive materials were processed into a plate in the same manner as in Example 1, the image quality was good similarly to Example 1 in each sample.

Further, when the environmental conditions in print making were changed to high temperature and high humidity (30° C. and 80% RH) or to low temperature and low humidity (15° C. and 20% RH), the image quality obtained was almost the same as that obtained in the print making at room temperature and normal humidity.

EXAMPLES 15 TO 22

Electrophotosensitive materials of Examples 15 to 22 were prepared by coating a support prepared in the manner of Example 1 except that the under layer was prepared to have a smoothness of 1,020 sec/10 cc with the following composition for the electrophotosensitive layer to give a dry coating weight of 22 g/m$^2$.

Formulation of Photosensitive Layer Composition

| | |
|---|---|
| Photoconductive zinc oxide (produced by Seido Kagaku KK) | 100 parts |
| Binder Resin (B-4) | 2 parts |
| Binder Resin (B-7) shown below | 5 parts |
| Binder Resin (B-8) shown below | 13 parts |
| Sensitizing Dye (S-8) shown below | 0.010 part |
| Chemical sensitizer shown in Table 5 below | $1.5 \times 10^{-3}$ mol |

Binder Resin (B-7)

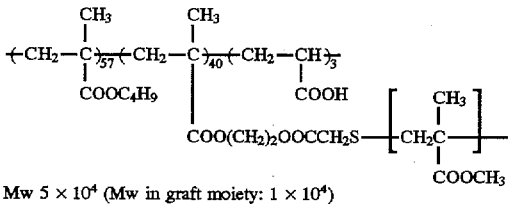

Mw $5 \times 10^4$ (Mw in graft moiety: $1 \times 10^4$)

Binder Resin (B-8)

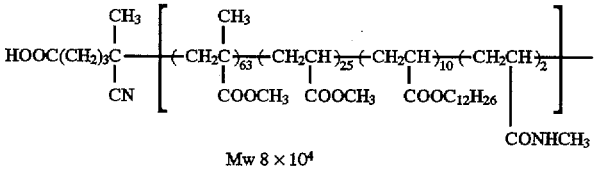

Mw $8 \times 10^4$

Sensitizing Dye (S-8)

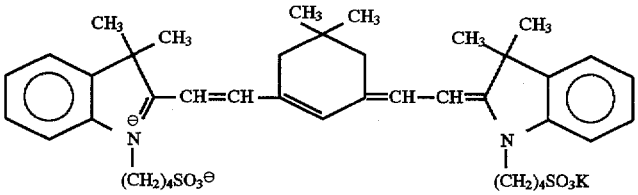

TABLE 5

| Example | Chemical Sensitizer |
|---|---|
| 15 | N-Hydroxy-5-norbornene-2,3-dicarboxyimido |
| 16 | N-Hydroxy-1-cyclohexene-1,2-dicarboxyimido |
| 17 | N-Hydroxy-1,8-naphthalimido |
| 18 | N-Phthaloyl-L-glutaric anhydride |
| 19 | 3-Phenoxypropionic acid/2,3-dimethylmaleic anhydride ⅓ by mol) |
| 20 | 4-Methoxycarbonylphthalic anhydride/lauric acid ⅔ by mol) |
| 21 | 3,3',4,4'-Benzophenonetetracarboxylic dianhydride |

TABLE 5-continued

| Example | Chemical Sensitizer |
|---|---|
| 22 | Cyclohexane 1,2-dicarboxylimido/4-methoxybutyric acid (⅓ by mol) |

When the photosensitive materials were processed into a plate in the same manner as in Example 1, the image quality was good similarly to Example 1 in each sample.

Further, when the environmental conditions in print making were changed to high temperature and high humidity (30° C. and 80% RH) or to low temperature and low humidity (15° C. and 20% RH), the image quality obtained was almost the same as that obtained in the print making at room temperature and normal humidity.

According to the present invention, an image formation method using beam exposure is provided, which ensures good electrophotographic properties even upon beam exposure using a near infrared or infrared light, gives an image extremely excellent in the image quality and is suitable for development in a direct feeding system. In particular, an image formation method using beam exposure is provided, which can give a very superior image even when the environmental conditions at the image formation changes.

While the invention has been described in detail and with reference to specific embodiments thereof, it will be apparent to one skilled in the art that various changes and modifications can be made therein without departing from the spirit and scope thereof.

What is claimed is:

1. A method for forming an image using beam exposure of an electrophotosensitive material comprising an electrically conductive support having thereon an electrophotosensitive layer containing an inorganic photoconductor, a chemical sensitizer, a spectral sensitizing dye and a binder resin, wherein said spectral sensitizing dye is at least one dye selected from the compounds represented by the following formulae (I) and (II) and the surface of the electrically conductive support on the side of said electrophotosensitive layer has a BEKK smoothness of 300 sec/10 cc or more:

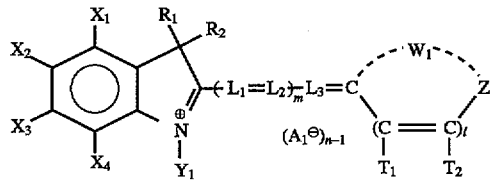

(I)

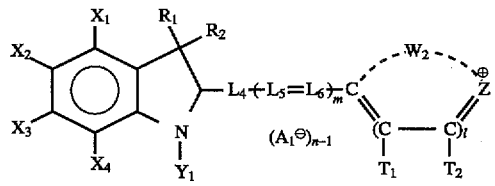

(II)

wherein $R_1$ and $R_2$, which may be the same or different, each represents an alkyl group, an alkenyl group or an aralkyl group or $R_1$ and $R_2$ each may be a hydrocarbon group forming an alicyclic ring;

$X_1$, $X_2$, $X_3$ and $X_4$, which may be the same or different, each represents a hydrogen atom or a group selected from respective substituent groups defined by the Hammett's substituent constant, or $X_1$ and $X_2$ or $X_3$ and $X_4$ each may be a hydrocarbon group forming a benzene ring;

$Y_1$ represents an alkyl, alkenyl or aralkyl group which may be substituted;

Z represents an oxygen atom, a sulfur atom, a selenium atom, a tellurium atom or a nitrogen atom substituted by a substituent $Y_2$ (wherein $Y_2$ has the same meaning as $Y_1$ above and $Y_1$ and $Y_2$ in each formula may be the same or different);

$W_1$ represents an atomic group necessary for forming an indolenine, naphthoindolenine, pyran, benzopyran, naphthopyran, thiopyran, benzothiopyran, naphthothiopyran, selenapyran, benzoselenapyran, naphthoselenapyran, tellurapyran, benzotellurapyran, naphthotellurapyran, benzothiazole or naphthothiazole ring which may be substituted or an atomic group necessary for forming a nitrogen-containing heterocyclic ring which may be substituted;

$W_2$ represents an onium salt of a heterocyclic group as formed in the manner defined for $W_1$;

$T_1$ and $T_2$, which may be the same or different, each represents a hydrogen atom, an aliphatic group or an aromatic group;

$L_1$, $L_2$, $L_3$, $L_4$, $L_5$ and $L_6$, which may be the same or different, each represents a methine group which may be substituted;

l represents 0 or 1;

m represents 2 or 3;

$A_1^-$ represents an anion; and n represents 1 or 2, provided that when the dye molecule contains a sulfo group or a phospho group, an inner salt is formed and n is 1.

2. The image formation method using beam exposure as claimed in claim 1, wherein said electrically conductive support has a resin layer in a thickness of 10 μm or more which is melt-bonded to the support and the surface of the support on the side of said electrophotosensitive layer has a BEKK smoothness of 300 sec/10 cc or more.

3. The image formation method using beam exposure as claimed in claim 1, wherein said electrophotosensitive material is subjected to wet development by disposing an electrode to face the electrophotosensitive layer, supplying a developer between said electrode and the electrophotosensitive layer and bringing a conductor into contact with the surface of the support on the side opposite to the electrophotosensitive layer.

4. An electrophotosensitive material comprising an electrically conductive support having thereon an electrophotosensitive layer containing an inorganic photoconductor, a chemical sensitizer, a spectral sensitizing dye and a binder resin, wherein said spectral sensitizing dye is at least one dye selected from the compounds represented by the following formulae (I) and (II) and the surface of the electrically conductive support on the side of said electrophotosensitive layer has a BEKK smoothness of 300 sec/10 cc or more:

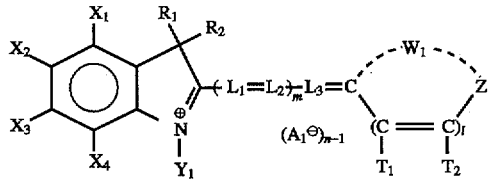

(I)

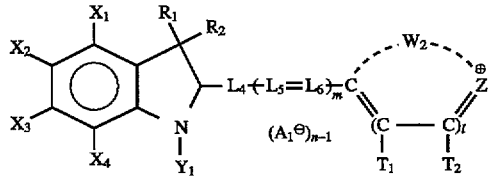

(II)

wherein $R_1$ and $R_2$, which may be the same or different, each represents an alkyl group, an alkenyl group or an aralkyl group or $R_1$ and $R_2$ each may be a hydrocarbon group forming an alicyclic ring;

$X_1$, $X_2$, $X_3$ and $X_4$, which may be the same or different, each represents a hydrogen atom or a group selected from respective substituent groups defined by the Hammett's substituent constant, or $X_1$ and $X_2$ or $X_3$ and $X_4$ each may be a hydrocarbon group forming a benzene ring;

$Y_1$ represents an alkyl, alkenyl or aralkyl group which may be substituted;

Z represents an oxygen atom, a sulfur atom, a selenium atom, a tellurium atom or a nitrogen atom substituted by a substituent $Y_2$ (wherein $Y_2$ has the same meaning as $Y_1$ above and $Y_1$ and $Y_2$ in each formula may be the same or different);

$W_1$ represents an atomic group necessary for forming an indolenine, naphthoindolenine, pyran, benzopyran, naphthopyran, thiopyran, benzothiopyran, naphthothiopyran, selenapyran, benzoselenapyran, naphthoselenapyran, tellurapyran, benzotellurapyran, naphthotellurapyran, benzothiazole or naphthothiazole ring which may be substituted or an atomic group necessary for forming a nitrogen-containing heterocyclic ring which may be substituted;

$W_2$ represents an onium salt of a heterocyclic group as formed in the manner defined for $W_1$;

$T_1$ and $T_2$, which may be the same or different, each represents a hydrogen atom, an aliphatic group or an aromatic group;

$L_1$, $L_2$, $L_3$, $L_4$, $L_5$ and $L_6$, which may be the same or different, each represents a methine group which may be substituted;

l represents 0 or 1;

m represents 2 or 3;

$A_1^-$ represents an anion; and n represents 1 or 2, provided that when the dye molecule contains a sulfo group or a phospho group, an inner salt is formed and n is 1.

5. The image formation method using beam exposure as claimed in claim 2, wherein said electrophotosensitive material is subjected to wet development by disposing an electrode to face the electrophotosensitive layer, supplying a developer between said electrode and the electrophotosensitive layer and bringing a conductor into contact with the surface of the support on the side opposite to the electrophotosensitive layer.

* * * * *